US007891800B2

(12) United States Patent
Holtman et al.

(10) Patent No.: US 7,891,800 B2
(45) Date of Patent: Feb. 22, 2011

(54) PRINTER WITH A PAPER TREATMENT SYSTEM

(75) Inventors: Lodewijk T. Holtman, Venlo (NL); Franciscus J. W. M. Wolters, Nijmegen (NL)

(73) Assignee: OCE-Technologies B.V., Venlo (NL)

( * ) Notice: Subject to any disclaimer, the term of this patent is extended or adjusted under 35 U.S.C. 154(b) by 684 days.

(21) Appl. No.: 11/285,062

(22) Filed: Nov. 23, 2005

(65) Prior Publication Data

US 2006/0109329 A1 May 25, 2006

(30) Foreign Application Priority Data

Nov. 25, 2004 (EP) ..... 04106086

(51) Int. Cl.
*B41J 2/01* (2006.01)

(52) U.S. Cl. ..... 347/102

(58) Field of Classification Search ..... 347/5, 347/14, 16, 17–19, 102, 101, 103
See application file for complete search history.

(56) References Cited

U.S. PATENT DOCUMENTS 4,694,307 A * 9/1987 Toganoh et al. ..... 347/85
4,870,432 A * 9/1989 Maeda et al. ..... 347/66
6,648,328 B2 * 11/2003 Sugimoto ..... 271/273
2003/0081097 A1 * 5/2003 Gil et al. ..... 347/102
2003/0137573 A1 7/2003 Rasmussen et al.
2004/0041893 A1 3/2004 Horshino
2004/0263600 A1 * 12/2004 Hoshino ..... 347/102

FOREIGN PATENT DOCUMENTS

EP 0 307 251 A2 3/1989

* cited by examiner

*Primary Examiner*—Stephen D Meier
*Assistant Examiner*—Alexander C Witkowski
(74) *Attorney, Agent, or Firm*—Birch Stewart Kolasch & Birch, LLP

(57) ABSTRACT

A printer having a sheet feed system for feeding an image receiving sheet to a print station, and a sheet treatment system for subjecting the paper to an anti-cockle treatment including a humidity sensor arranged to detect the degree of humidity of ambient air, and a control system adapted to control the sheet treatment system in response to the detected degree of humidity.

10 Claims, 1 Drawing Sheet

PRINTER WITH A PAPER TREATMENT SYSTEM

This non-provisional application claims priority under 35 U.S.C. §119(a) on Patent Application No. 04106086.4 filed in Europe on Nov. 25, 2004, which is herein incorporated by reference.

BACKGROUND OF THE INVENTION

The present invention relates to a printer having a paper feed system for feeding printing paper to a print station, and a paper treatment system for subjecting the paper to an anti-cockle treatment.

In printers in which paper or similar media are used as recording media, a tendency of the paper to cockle may sometimes constitute a serious problem. The cockling phenomenon is related to the fact that paper and similar materials tend to absorb humidity from ambient air and to expand and contract in accordance with their humidity content. Typically, the expansion and contraction is unisotropic and is particularly pronounced in a direction in which the fibers of the paper are predominantly oriented. When there exists a gradient in humidity within the paper, then the more humid portion of the paper will expand more than the drier portion, which inevitably leads to the production of cockles or wrinkles.

In a typical setup of an ink jet printer, for example, especially a large format printer, the paper is intermittently advanced over a flat sheet support plate, while a carriage moves back and forth across the paper, and ink jet printheads mounted on the carriage are energized to eject droplets of ink onto the paper so as to form a printed image. Since the carriage moves with relatively high velocity, the ink droplets ejected onto the paper undergo a certain aberration and are deposited on the paper in a somewhat dislocated position. The amount of dislocation is proportional to the flight distance of the ink droplets. Thus, when cockles are present in the paper, the flight distance is non-uniform and, accordingly, the dislocation of the spots of ink on the paper also becomes non-uniform, so that the quality of the printed image is deteriorated.

In a hot melt ink jet printer, the ink is solid at room temperature and must be heated above its melting point, typically in the order of magnitude of 100° C., before of droplets of liquid ink can be jetted onto the paper. As a result, when the image is being printed, the paper will be heated by the high temperature of the ink, and part of the water that has been absorbed in the paper will evaporate. This creates a humidity gradient in the paper in the area of the print station, and the production of cockles is likely to occur.

Several measures can be conceived of in order to cope with this cockling phenomenon in a printer. For example, the paper may be heated in order to reduce its intrinsic humidity content; mechanical means may be employed for forcibly holding the paper flat on the sheet support plate, and/or shielding measures may be taken for preventing the paper from coming into contact with humid ambient air, especially in a stand-by condition of the printer. However, whichever measures are taken for mitigating the cockling phenomenon, such measures generally have a negative effect on the productivity of the printer and/or lead to an increased energy consumption.

US 2003/0137573 discloses an ink jet printer of the type described above, having a vacuum belt forming the paper feed system, and a paper treatment system comprising a heater arranged at the vacuum belt.

US 2004/041893 and EP 0 307 251 disclose printers having a humidity sensor and a heater controlled thereby in order to adjust the temperature of the paper in the print station.

SUMMARY OF THE INVENTION

Accordingly, it is an object of the present invention to provide a printing system which permits a high productivity and has a low energy consumption and is nevertheless capable of suppressing the cockling phenomenon to a tolerable limit.

To this end, the printing system according to the present invention contains a humidity sensor arranged to detect the degree of humidity of ambient air, and a control system adapted to control the paper treatment system in response to the detected degree of humidity, and the paper treatment system is arranged upstream of a feed roller of the paper feed system in the direction in which the paper is fed.

The present invention is based on the consideration that the cockling tendency of the paper will depend on the degree of humidity of ambient air at the location where the printer is operating. When the air is relatively dry, the cockling tendency is low, and the anti-cockle treatment may be limited or dispensed with completely, so that less or no time and energy is wasted for the anti-cockle treatment. On the other hand, when the humidity of ambient air increases, this is detected by the humidity sensor, and the paper treatment system is automatically activated so as to mitigate the cockling phenomenon and to assure a high print quality.

In one of the embodiments of the present invention, the printing paper is provided in the form of an endless web that is wound on a reel in a paper magazine of the printing system and is drawn off from the reel during the printing process. The paper feed system includes guide plates which define a relatively narrow paper feed path for guiding the paper from the reel to the print station. This is particularly the case for a printing system which has a plurality of reels and permits the selection of different qualities or widths of recording media. In this situation, the guide plates of the paper feed system will define a paper feed path with several branches for guiding the paper from the various reels, and these branches will merge into a common path through which the paper is fed to the print station.

However, since mechanical components such as transport rollers, a cutting mechanism for cutting the web to the desired sheet length, and the like must be disposed at the paper feed path so as to come into contact with the paper, not all of the paper feed path can be bounded by the guide plates. Thus, the paper feed path will include certain sections where the paper is accommodated in a narrow space between the guide plates, and other sections where the paper is more exposed to ambient air. As a result, when the printer is an a stand-by condition, and the web of paper is not being transported, the paper will absorb humidity mainly in those sections of the feed path which are exposed to ambient air.

In an embodiment of the present invention, the guide plates defining the narrow sections of the paper feed path are perforated, so that the paper will be exposed to ambient air even in these sections. As a result, the portion of the paper web that rests in the paper feed path in the stand-by state will absorb humidity from the ambient air in a more uniform manner, so that the humidity gradient in the paper is prevented from becoming too large. This helps to avoid the production of cockles.

BRIEF DESCRIPTION OF THE DRAWINGS

A preferred embodiment of the present invention will now be described in conjunction with the drawings, in which.

DETAILED DESCRIPTION OF THE INVENTION

Figure 1:
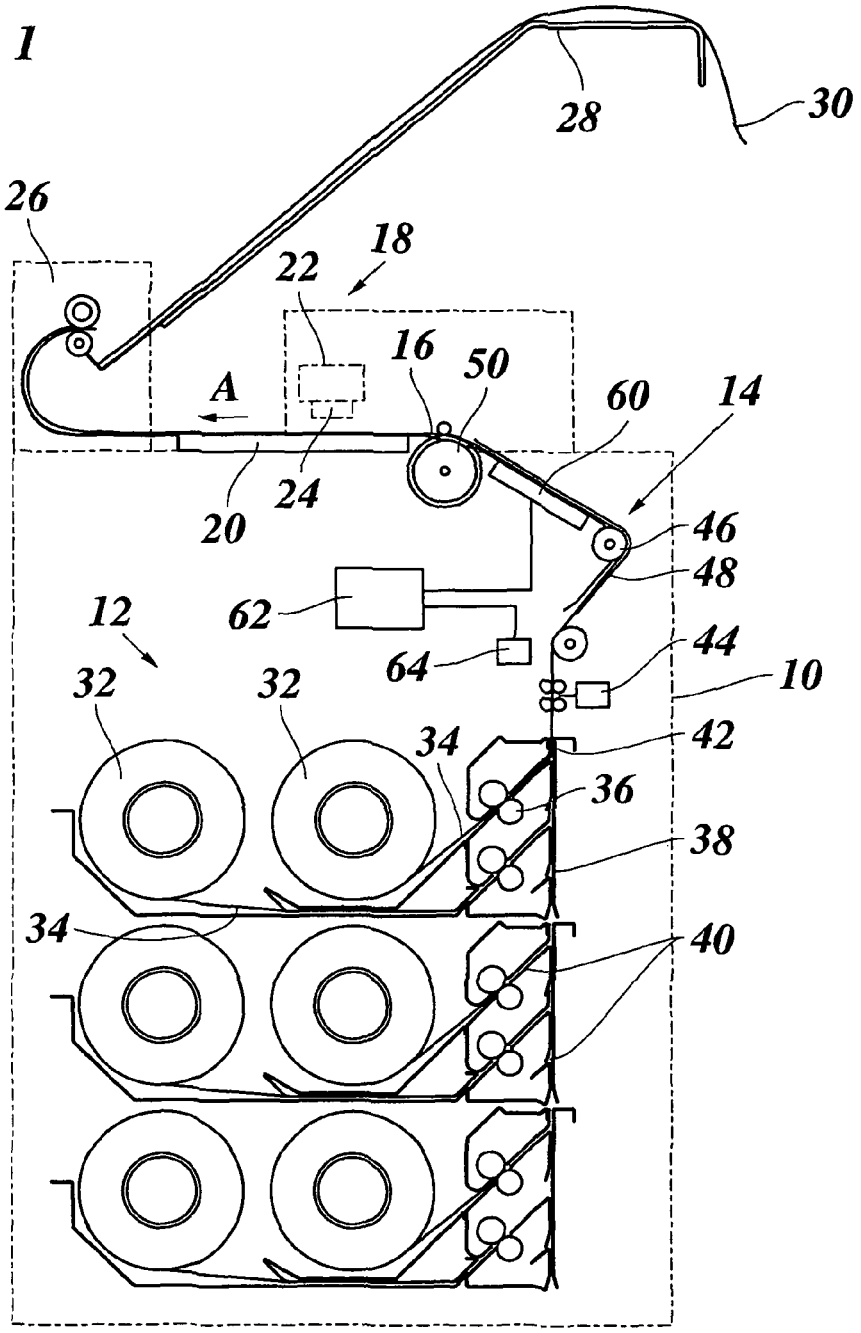
FIG. 1 shows a schematic vertical cross-section of a paper transport system of a hot-melt ink jet printer according to the present invention.

As is shown in FIG. 1, a hot melt ink jet printer system includes a frame 10 (which has only been shown in phantom lines) and which accommodates a paper magazine 12 and a paper feed system 14 adapted to feed a sheet 16 of paper to a print station 18 on the top side of the frame 10. In the print station 18, the sheet 16 is drawn against a flat top surface of a perforated sheet support plate 20 by means of a vacuum system (not shown). A carriage 22 is arranged to travel back and forth across the sheet 16 in the direction normal to the plane of the drawing in FIG. 1 and carries at its bottom side a number of hot melt ink jet printheads 24 facing the sheet 16. Thus, by energizing the printheads 24, a swath of an image is printed in each pass of the carriage 22. Then, the sheet 16 is advanced by a step of appropriate length in a direction indicated by an arrow A, so that the next swath can be printed. A discharge mechanism 26 discharges the sheet onto a tray 28 which, in the example shown, accommodates already a printed sheet 30. The sheet support plate 20 is temperature-controlled in order to control the cooling rate and the solidification of the hot melt ink that has been deposited on the paper.

The paper magazine 12 includes a set of six reels 32 each providing a supply of printing paper in the form of an endless web 34. The reels 32 are arranged in three levels, and the web 34 from each reel is drawn-off by means of a respectively associated pair of transport rollers 36. An arrangement of guide plates 38 defines a branched system of narrow feed paths 40 which merge into a common feed path 42 on the top side of the paper magazine. The pairs of transport rollers 36 are selectively driven to feed the web 34 from a selected one of the reels 32 to the common feed path 42. It will be understood that the reels 32 may contain paper of different qualities and possibly also non-paper recording media such as plastic films or the like. Further, the webs on the reels 32 may differ in width, so that printed sheets may be produced in different formats, ranging for example from A4 portrait to A0 landscape.

From the common feed path 42, the selected web is guided past a cutting mechanism 44 for cutting the web to the desired sheet length, and then the cut sheet 16 is guided over a system of deflection and tensioning rollers 46 and guide plates 48 to a platen 50 from which it is paid out onto the sheet support plate 20.

On its way from the reel 32 to the platen 50, the web 34 and the sheet 16, respectively, will inevitably be exposed to ambient air and, as a result, will absorb humidity, especially when the relative humidity RH of the ambient air is high. In the example shown, the paper is particularly exposed to ambient air in the vicinity of the cutting mechanism 44.

Figure 2:
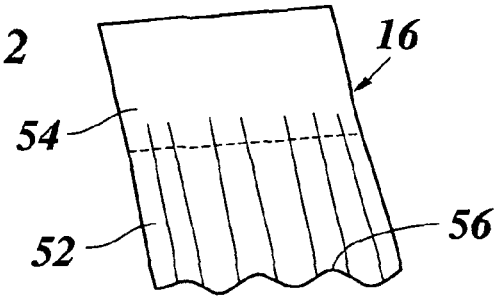
FIG. 2 is a schematic view of a paper sheet, illustrating the occurrence of cockles caused by a humidity gradient in the paper.

When the humidity content of the paper increases, it tends to expand, in particular in the direction in which the fibers in the paper are predominantly oriented. Typically, this is the direction transverse to the longitudinal direction of the web. When the sheet 16, after having expanded in this way, reaches the sheet support plate 20 and is heated by the hot melt ink deposited thereon, part of the water contained in the paper will be evaporated, and the paper shrinks again in the width direction of the sheet. Thus, since a humidity gradient is present in the paper, the accompanying reduction in width of the sheet leads to the production of cockles. This has exaggeratedly been illustrated in FIG. 2, where a dashed line indicates an approximate boarder between a more humid portion 52 and a drier portion 54 of the sheet 16. The shrinkage in width of the drier portion 54 leads to the formation of cockles 56 in the portion 52.

In order to reduce the occurrence of such cockles 56 especially in the area of the print station 18, a heater 60 is provided at the paper feed path upstream of the platen 50, so that the humidity content of the sheet 16 is preliminarily reduced before it enters the print station.

The heater 60 is controlled by an electronic control system 62 which is also connected to a humidity sensor 64. In the example shown, the sensor 64 is arranged in a position where it can detect the humidity of air near a portion of the paper feed path where the paper is particularly exposed to ambient air. Thus, when the air humidity is high, the heater 60 is heated to a higher temperature in order to drive the humidity out of the paper more efficiently. When the air humidity is lower, the temperature of the heater 60 may be reduced, so that energy consumption is also reduced. Below a certain threshold level of 40% RH, for example, the heater 60 may be switched off completely, because, then, the amount of cockling is within tolerable limits, anyway.

The control system 62 may also be programmed to establish a different relation between the detected air humidity and the temperature of the heater 60 depending on the quality, e.g., paper weight of the print medium on the selected reel 32. For example, the threshold for switching between an ON and OFF state of the heater may be shifted.

In addition, the heater 60 may be segmented in the width direction, an the width of the active part of the heater will automatically be adapted to the width of the paper web, so as to avoid a waste of heat energy.

Figure 3:
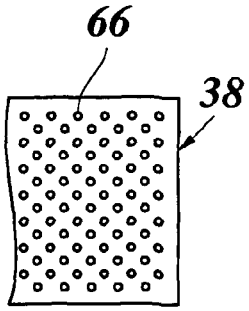
FIG. 3 is a partial view of a guide plate delimiting a paper feed path in the printer shown in FIG. 1.

As has been shown in FIG. 3, the guide plates 38 bounding the various branches of the paper feed paths 40 have a pattern of perforations 66 which are small enough to assure that the paper is smoothly guided between the guide plates but, on the other hand are sufficiently large and numerous to expose the paper to ambient air even in the narrow spaces between the guide plates 38. As a result, when the printer is in stand-by, the portions of the web 34 inside and outside of the narrow passages defined by the guide plates 38 will be exposed to ambient air to approximately the same extent, and this helps to reduce the gradient of humidity developing in the paper during the stand-by period. This will reduce the amount of cockles that are already present in the paper when the printer starts to operate again and the sheet 16 is fed to the platen 50.

If the printer is not a hot melt printer but an ink jet printer operating with ink that is liquid at room temperature, so that no temperature and humidity gradient will be caused by the hot ink, the perforation of the guide plates 38 alone may be sufficient to suppress cockling below tolerable limits.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An ink jet printer having a sheet feeding system for feeding an image receiving sheet to a print station, and a treatment system for subjecting the imaging receiving sheet to an anti-cockle treatment, which comprises a humidity sensor arranged to detect the degree of humidity of ambient air, and a control system adapted to control the sheet treatment system in response to the detected degree of humidity and the treatment system is arranged upstream of a feed roller of the sheet feeding system in the direction in which the paper is fed, wherein the sheet feed system defines at least one feed path having at least one section where the paper is exposed to ambient air said at least one section guiding the paper between guide plates positioned upstream of the print station, wherein the guide plates, which define narrow spaces of the paper feed pack, contain perforations so that the sheet is exposed to ambient air also between the guide plates.

2. The printer according to claim 1, wherein the control system is adapted to switch off the treatment system when the detected degree of humidity is below a certain threshold level.

3. The printer according to claim 1, wherein the treatment system includes a heater for heating the printing sheet before it is fed to the print station.

4. The printer according to claim 2, wherein the treatment system includes a heater for heating the printing sheet before it is fed to the print station.

5. The printer according to claim 1, wherein the control system is adapted to establish different relations between the detected degree of humidity and the activity of the treatment system depending on the type of printing sheet being fed to the print station.

6. The printer of claim 5, wherein a magazine is adapted to store a plurality of stocks of printing sheets, the sheet feeding system being adapted to selectively feed sheets from one of the stocks of the magazine to the print station.

7. The printer of claim 1, wherein at least one reel is provided to supply an endless web of printing sheets.

8. The printer of claim 1, said printer being a hot melt ink jet printer.

9. The printer of claim 1, wherein the guide plates have a pattern of perforations which are small enough to smoothly guide the image receiving sheet between the guide plates and are sufficiently large and numerous to expose the image receiving sheet to ambient air in said narrow spaces between the guide plates.

10. The ink jet printer of claim 9, wherein guide plates contain perforations which are uniformly disposed therein.

* * * * *